US005742971A

United States Patent [19]

Salinger

[11] Patent Number: 5,742,971

[45] Date of Patent: Apr. 28, 1998

[54] SUCTION CUP TOOTHBRUSH

[76] Inventor: Stephen Forrest Salinger, 134 Plumtree, Deerfield, Ill. 60015

[21] Appl. No.: 565,034

[22] Filed: Nov. 30, 1995

[51] Int. Cl.[6] ..... A46B 9/04

[52] U.S. Cl. ..... 15/167.1; 15/143.1

[58] Field of Search ..... 15/167.1, 143.1; 248/205.5, 206.2, 467, 683

[56] References Cited

U.S. PATENT DOCUMENTS

| | | | |
|---|---|---|---|
| 1,800,218 | 4/1931 | Janda | 248/205.5 |
| 1,899,242 | 2/1933 | McNab | 15/167.1 |
| 2,110,315 | 3/1938 | Wolfson | 15/167.1 |
| 2,164,219 | 6/1939 | McGerry | 15/167.1 |
| 3,046,588 | 7/1962 | Tobolski et al. | 15/167.1 |
| 4,589,159 | 5/1986 | Streibel | 15/167.1 |
| 4,979,708 | 12/1990 | Aoki | 248/206.2 |
| 5,400,457 | 3/1995 | Ridgley | 15/167.1 |

*Primary Examiner*—Terrence Till
*Attorney, Agent, or Firm*—Laff, Whitesel Conte & Saret, Ltd.

[57] ABSTRACT

A toothbrush has a swivel mounted vacuum cup on the end of the handle which is remote from the bristles so that, when stored, the brush hangs down under gravity in a sanitary position.

2 Claims, 1 Drawing Sheet

SUCTION CUP TOOTHBRUSH

FIELD OF THE INVENTION

This invention relates to toothbrushes and more particularly to toothbrushes having a handle which facilitates easy and sanitary storage.

BACKGROUND OF THE INVENTION

As personal habits in the use of a toothbrush change, it can be and has been stored almost anywhere. Usually, toothbrushes have been stored in one of three ways. 1) Laying flat, horizontally, as on a counter or shelf for example; 2) semi-vertically in glass or cup; or 3) vertically in a holder. The second two of these methods require additional apparatus. The first method is not sanitary since the brush laying on the shelf may pick up almost any contaminant existing there. Hanging a brush in a holder tends to collect possible contaminants on the holder as spent toothpaste, saliva which create unsanitary conditions.

Accordingly, an object of this invention is to enable a toothbrush to be stored securely, safely, and in a sanitary manner, and yet to be readily accessible.

SUMMARY

In keeping with an aspect of the invention, a toothbrush has a handle with a vacuum cup attached to its end by a swivel joint. Thus, when the vacuum cup is attached to a mirror, for example, the toothbrush hangs under gravity in a sanitary position.

DETAILED DESCRIPTION OF THE INVENTION

Figure 1:
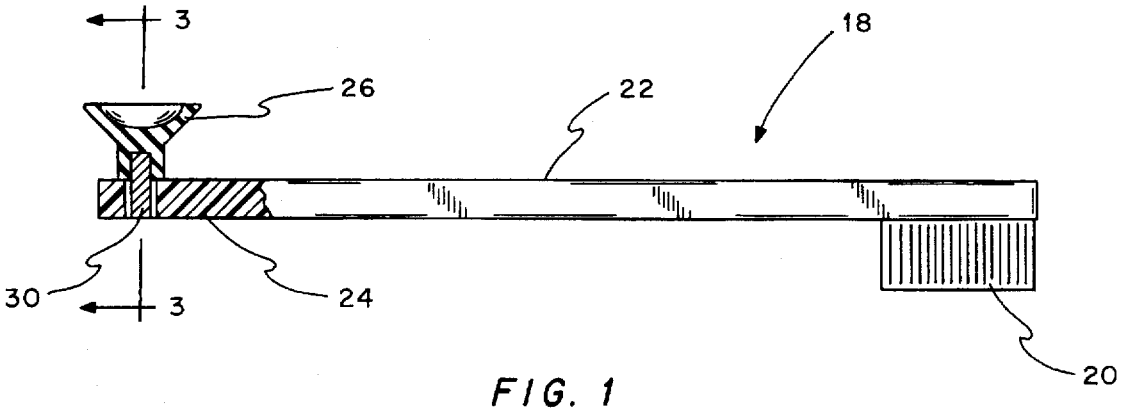
FIG. 1 is a side elevation of the invention.
Figure 2:
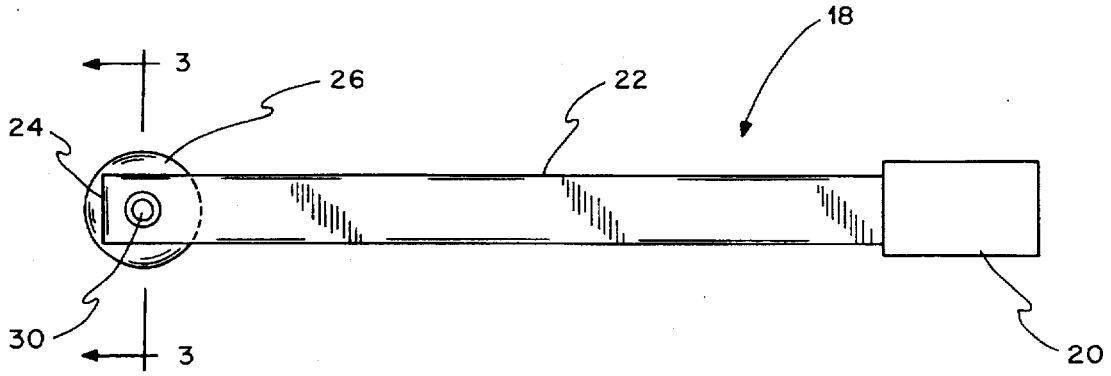
FIG. 2 is a bottom plan view of the invention.
Figure 3:
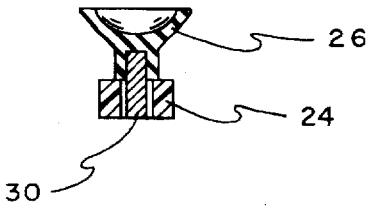
FIG. 3 is a section view taken along line 3—3 of FIG. 2.

The inventive toothbrush 18 may have any standard variety of head 20 and handle 22. At the end 24 of the handle remote from the brush, there is a suction cup 26 that, when moistened will allow the brush to be hung on any smooth, flat, non-porous surface. Such surfaces include glass, mirrors, porcelain, plastic, ceramic and plastic tiles, and formica, material typically used in bathrooms and kitchens. The vacuum or suction cup is attached to the handle by a swivel joint 28. the vacuum or suction cup faces outwardly from the back of handle 22 (i.e., the brush 20 faces one way and the suction cup 26 faces the other way). The toothbrush 18 hangs down, under gravity, with the bristles facing away from the surface so that the bristles do not come into contact with contaminants on the surface and also so that they may drip and air dry.

More particularly, this invention comprises a toothbrush 18 of integral construction made of synthetic plastics, for example, having a head portion 20, a handle potion 22 and a vacuum or suction cup 26. Any toothbrush handle which is at least 7¾ inches long can be incorporated with the suction device. The head may be square, rectangular, diamond, oblong, ovoid or round. It has bristles perpendicular to the long axis of the handle 22. All of the bristles may be the same length or may be varied in any suitable pattern of rows or designs. The preferred bristles requirements are that it have rounded bristles of about 0.021 mm diameter. The handle 22 may be straight or curved or angled.

On the end 24 opposite the brush part or head 20, is a vacuum or suction cup 26 that when moistened will allow the brush to be stored in a vertical head down position. The vacuum or suction cup 26 is attached to the handle by a screw or rivet 30 having a circular cross section so that handle 22 is free to rotate relative to the suction cup 26.

The suction cup allows the brush to be hung on any smooth flat, non-porous surface. Such surfaces include: glass, glass mirrors, plastic, plastic or ceramic tiles, formica, etc.—all of which are usually present in bathrooms and kitchens.

The preferred vacuum or suction cup 26, is about two centimeters in diameter and is mounted at the handle end 24 opposite the head or the brush 20. The vacuum cup projects from handle 18 at a 90-degree angle relative to the length of the handle and at 180-degrees relative to the bristled head. the vacuum cup 26 is made of a dishwasher safe pliable plastic or rubber which can withstand dishwasher temperatures. It is attached near the end of the handle. The approximately ⅜ inch tall suction cup is secured in place by a metal or plastic screw or rivet 30, which may go through the handle and fasten securely into the cup.

The screw or rivet acts as a swivel or an axle and allows the brush and the suction cup to rotate under gravity freely and individually from each other. It should be noted that the screw or rivet head is either slightly rounded or flat and flush with the handle's surface so it will stay clean. The screw or rivet may be made of brass or aluminum or any other treated metal that will not rust; or, it may be made of plastic such that it may be made integral with the handle, screw, snap or otherwise fasten into the suction cup.

After a person is done brushing his/her teeth, the suction cup is moistened with either water or saliva and is then pressed firmly onto the smooth non-porous surface. The brush can then be stored or kept in that position until dry or until its next use.

Those who are skilled in the art will readily perceive how to modify the invention. Therefore, the appended claims are to be construed to cover all equivalent structures which fall within the true scope and spirit of the invention.

What is claimed is:

1. A toothbrush of integral construction, said toothbrush comprising a head portion and an elongated handle, said head portion having bristles at one end of said elongated handle, a vacuum cup attached near an opposite end of said elongated handle and on a side of said elongated handle opposite the bristles, and said vacuum cup being attached to said elongated handle by a swivel joint so that when said vacuum cup is used to store the toothbrush, said toothbrush hangs down under gravity in a vertical, sanitary position;

said swivel joint which attaches said vacuum cup to said elongated handle is selected from a group consisting of a rivet and a screw extending perpendicularly from the elongated handle, the toothbrush swinging freely to rotate about said selected one of said rivet and screw;

said selected one of said rivet and screw extends through said handle and terminates substantially in a plane of said elongated handle on a side opposite said vacuum cup in order to help keep said selected one of said rivet and screw clean and sanitary.

2. The toothbrush of claim 1 wherein said vacuum cup is made of a pliable and resilient material which is able to withstand hot dishwasher water.

* * * * *